US010689951B2

(12) United States Patent
Newell et al.

(10) Patent No.: US 10,689,951 B2
(45) Date of Patent: Jun. 23, 2020

(54) WELL TEST BURNER SYSTEM AND METHODS OF USE

(71) Applicant: HALLIBURTON ENERGY SERVICES, INC., Houston, TX (US)

(72) Inventors: Elling James Newell, Argyle, TX (US); Mark Henry Strumpell, Allen, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 353 days.

(21) Appl. No.: 15/578,208

(22) PCT Filed: Jun. 29, 2015

(86) PCT No.: PCT/US2015/038259

§ 371 (c)(1),
(2) Date: Nov. 29, 2017

(87) PCT Pub. No.: WO2017/003420

PCT Pub. Date: Jan. 5, 2017

(65) Prior Publication Data

US 2018/0148996 A1 May 31, 2018

(51) Int. Cl.
*E21B 36/02* (2006.01)
*F23D 14/02* (2006.01)
(Continued)

(52) U.S. Cl.
CPC ..... *E21B 36/02* (2013.01); *F23D 14/02* (2013.01); *F23D 14/48* (2013.01); *F23D 14/825* (2013.01); *F23D 91/00* (2015.07); *F23D 2900/21* (2013.01)

(58) Field of Classification Search
CPC ..... F23G 7/05; F23G 7/085; E21B 41/0071; F23D 23/00; F23D 11/102; F23D 11/101; F23D 11/103
See application file for complete search history.

(56) References Cited

U.S. PATENT DOCUMENTS 2,586,224 A * 2/1952 Harris ..... F23D 23/00 239/126
4,139,339 A * 2/1979 Straitz, III ..... F23G 5/50 422/168

(Continued)

FOREIGN PATENT DOCUMENTS

WO 2014/120230 A1 8/2014
WO 2014/120231 A1 8/2014

(Continued)

OTHER PUBLICATIONS

International Search Report and Written Opinion for PCT/US2015/038259 dated Feb. 29, 2016.

(Continued)

*Primary Examiner* — Kipp C Wallace
(74) *Attorney, Agent, or Firm* — Gilliam IP PLLC

(57) ABSTRACT

A well test burner system includes a plurality of burner nozzles, each including an air valve and a well product valve movable between an open position, where air and a well product are allowed to circulate through the burner nozzle to discharge an air/well product mixture, and a closed position, where the air and the well product are prevented from circulating through the burner nozzle. One or more actuation devices are operatively coupled to the air valve and the well product valve to move the air valve and the well product valve between the open and closed positions.

20 Claims, 8 Drawing Sheets

(51) Int. Cl.

| | |
|---|---|
| ***F23D 99/00*** | (2010.01) |
| ***F23D 14/48*** | (2006.01) |
| ***F23D 14/82*** | (2006.01) |

(56) References Cited

U.S. PATENT DOCUMENTS

| | | | | |
|---|---|---|---|---|
| 4,348,171 | A * | 9/1982 | Issenmann | E21B 41/0071 431/202 |
| 5,096,124 | A | 3/1992 | Young | |
| 5,636,980 | A * | 6/1997 | Young | F23D 23/00 431/202 |
| 5,743,726 | A * | 4/1998 | Werding | F23C 7/02 431/157 |
| 5,997,280 | A | 12/1999 | Welz, Jr. et al. | |
| 6,027,332 | A | 2/2000 | Glotin et al. | |
| 2002/0094498 | A1 | 7/2002 | Ridriguez-Rodriguez et al. | |
| 2007/0264602 | A1 * | 11/2007 | Frenette | F02D 19/08 431/253 |
| 2012/0270161 | A1 | 10/2012 | Poe et al. | |
| 2014/0147795 | A1 * | 5/2014 | Tremblay | F23G 7/085 431/5 |
| 2014/0162197 | A1 * | 6/2014 | Krichtafovitch | F23C 99/001 431/2 |
| 2016/0290635 | A1 * | 10/2016 | Frenette | F23D 14/24 |

FOREIGN PATENT DOCUMENTS

| | | | | |
|---|---|---|---|---|
| WO | 2014/120235 | A1 | 8/2014 | |
| WO | 2014/120237 | A1 | 8/2014 | |
| WO | WO-2014120231 | A1 * | 8/2014 | F23D 23/00 |
| WO | WO-2014120235 | A1 * | 8/2014 | F23D 14/48 |

OTHER PUBLICATIONS

International Preliminary Report on Patentability from PCT/US2015/038259, dated Jan. 2, 2018, 9 pages.

* cited by examiner

WELL TEST BURNER SYSTEM AND METHODS OF USE

The present application is a U.S. National Phase entry under 35 U.S.C. § 371 of International Application No. PCT/US2015/038259, filed on Jun. 29, 2015, the entirety of which is incorporated herein by reference.

BACKGROUND

Prior to connecting a well to a production pipeline, a well test is typically performed where the well is produced and production fluids derived from the well, such as crude oil and gas, are evaluated. Following the well test, the collected production fluids must be disposed of. In certain instances, the production fluid is separated and a portion thereof (i.e., substantially crude oil) may be disposed of by burning using a well test burner system. On offshore drilling platforms, for example, well test burner systems are often mounted at the end of a boom that extends outward from the side of the platform. As the well is tested, the produced crude is piped out the boom to the well test burner system and burned. Well test burner systems are also often used in conjunction with land-based wells.

Conventional well test burner systems include several burner nozzles that receive and burn the production fluids and simultaneously allow the well test burner system to operate over a wide range of flow rates. Burner nozzles are often selectively capped to reduce the flow rate through the well test burner system when desired. The un-capped burner nozzles have large amounts of air and oil flowing through them, which serves to remove thermal energy and thereby keeps them cool. The capped nozzles, however, are exposed to radiant heat emitted from the flame discharged from the un-capped nozzles. Such radiant heat can sometimes result in seal failure for the un-capped nozzles, and seal failures can present various safety issues and result in environmental damage.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to well operations in the oil and gas industry and, more particularly, to well test burner systems and methods of operating well test burner systems to reduce radiant heat seal failures.

The embodiments described herein describe a well test burner system having a plurality of burner nozzles that are selectively actuatable between open and closed positions. Each burner nozzle may include an air valve and a well product valve movable between open and closed positions. In the open position, air and a well product are allowed to circulate through the burner nozzle to discharge an air/well product mixture. In the closed position, the air and the well product are prevented from circulating through the burner nozzle. One or more actuation devices may be operatively coupled to the air valve and the well product valve of each burner nozzle to selectively move the air and well product valves between the open and closed positions. By varying the flow to each burner nozzle, regardless of flow rate of the air and well product, the burner nozzles and their component parts, may be maintained within reasonable temperature ranges, which may help mitigate adverse effects of radiant thermal energy emitted from adjacent burner nozzles.

Figure 1A:
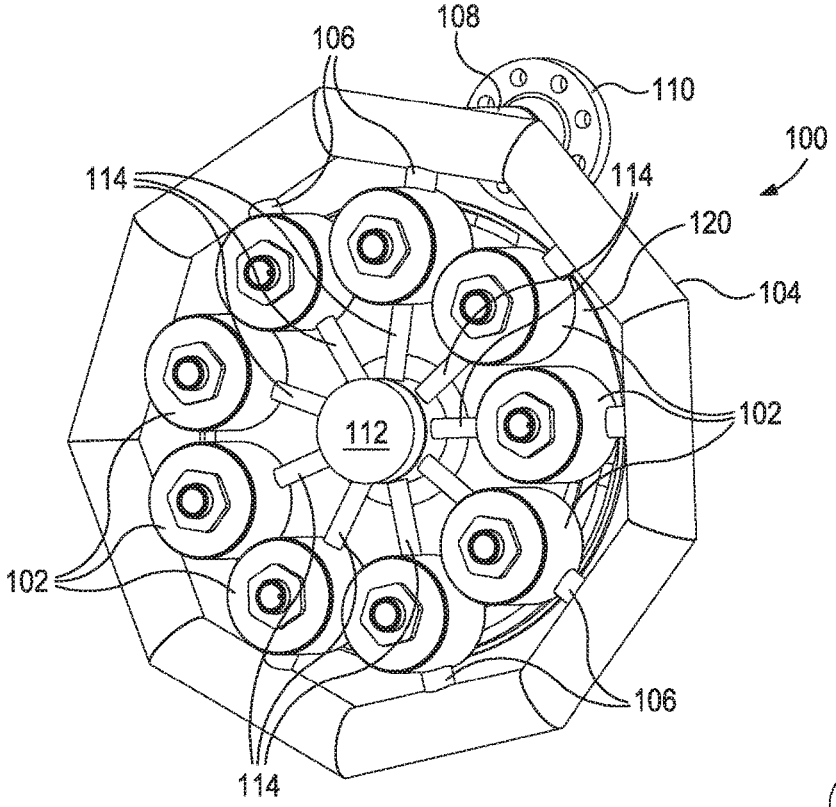
FIGS. 1A and 1B are perspective and side views, respectively, of an example well test burner system that may employ the principles of the present disclosure.
Figure 1B:
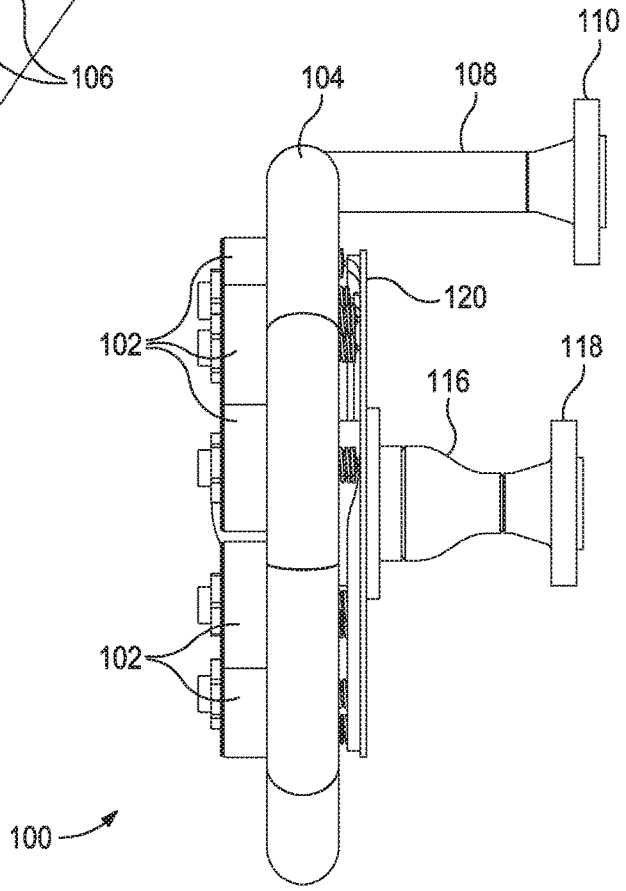

Referring to FIGS. 1A and 1B, illustrated are perspective and side views, respectively, of an example well test burner system 100 that may employ the principles of the present disclosure, according to one or more embodiments. The well test burner system 100 (hereafter the "burner system 100") may be used to burn a well product produced from a well during the test phase for the well or anytime thereafter (i.e., a production fluid). Such well products can include crude oil, hydrocarbon gases, and mixtures thereof. In certain applications, the burner system 100 may be situated on an offshore drilling platform and mounted to a boom that extends outward from the platform. In other applications, the burner system 100 could be mounted to a skid or similar mounting structure for use with a land-based well. It will be appreciated that the depicted burner system 100 is but one example of suitable well test burner systems that may benefit from the principles of the present disclosure.

As illustrated, the burner system 100 includes a plurality or array of burner nozzles 102 arranged in a ring-like or circular pattern and angularly offset from each other. In some embodiments, however, the burner nozzles 102 may be arranged in a polygonal pattern, such as square or rectangular, without departing from the scope of the disclosure. The burner nozzles 102 are adapted to receive and combine air and a well product (e.g., crude oil) to a specified ratio to expel an air/well product mixture to be burned. It should be noted that while nine burner nozzles 102 are depicted in FIG. 1, more or less than nine burner nozzles 102 may be arranged in the circular array and otherwise employed in burner system 100, without departing from the scope of the disclosure.

Each burner nozzle 102 is individually coupled to and receives a supply of air via an air inlet manifold 104, which, as illustrated, may comprise a generally circular pipe or tubing that extends about the circular array of burner nozzles 102. Each burner nozzle 102 may be placed in fluid communication with the air inlet manifold 104 via a corresponding air inlet pipe 106 that extends radially between each burner nozzle 102 and the air inlet manifold 104. A supply of air may be provided to the air inlet manifold 104 via air piping 108, which is then provided to the burner nozzles 102 via the corresponding air inlet pipes 106. As illustrated, the air piping 108 may terminate at a flange 110, which allows the air piping 108 to be coupled to a source of air, such as an air compressor or the like.

Each burner nozzle 102 may also be individually coupled to and receive the well product to be disposed of via a well product inlet manifold 112, which, as illustrated, may be concentrically-positioned within the circular array of the burner nozzles 102. Each burner nozzle 102 may be placed in fluid communication with the well product inlet manifold 112 via a corresponding well product inlet pipe 114 that extends radially between each burner nozzle 102 and the well product inlet manifold 112. A supply of well product may be provided to the well product inlet manifold 112 via well product piping 116 (best seen in FIG. 1B), which is then provided to each burner nozzle 102 via the corresponding product inlet pipes 114. As illustrated, the well product piping 116 may terminate at a flange 118, which allows the well product piping 116 to be coupled to a line or conduit that conveys the well product to the burner system 100 to be disposed of (i.e., burned). In certain instances, one or both of the air and well product piping 108, 116 may comprise a rigid pipe. In other applications, however, one or both of the air and well product piping 108, 116 may comprise a flexible hose or conduit.

As best seen in FIG. 1B, the burner system 100 may further include an actuation device 120 operatively coupled to each burner nozzle 102 and used to selectively control the flow of air and well product supplied to the burner nozzles 102. Controlling the flow of air and well product to the burner nozzles 102 may help mitigate the adverse effects of radiant thermal energy emitted from adjacent operating burner nozzles 102, and thereby extend the operating life of the burner nozzles 102. In the illustrated embodiment, the actuation device 120 is depicted as a cam plate configured to rotate and thereby sequentially actuate valves of each burner nozzle 102 between open and closed positions. In other embodiments, however, the actuation device 120 may comprise one or more actuation mechanisms (e.g., mechanical, electromechanical, hydraulic, pneumatic, etc.) coupled to valves of each burner nozzle 102. Upon receipt of a command signal, such actuation mechanisms may selectively move the valves of the burner nozzle 102 between open and closed positions. The various embodiments of the actuation device 120 are described in greater detail below.

Figure 2:
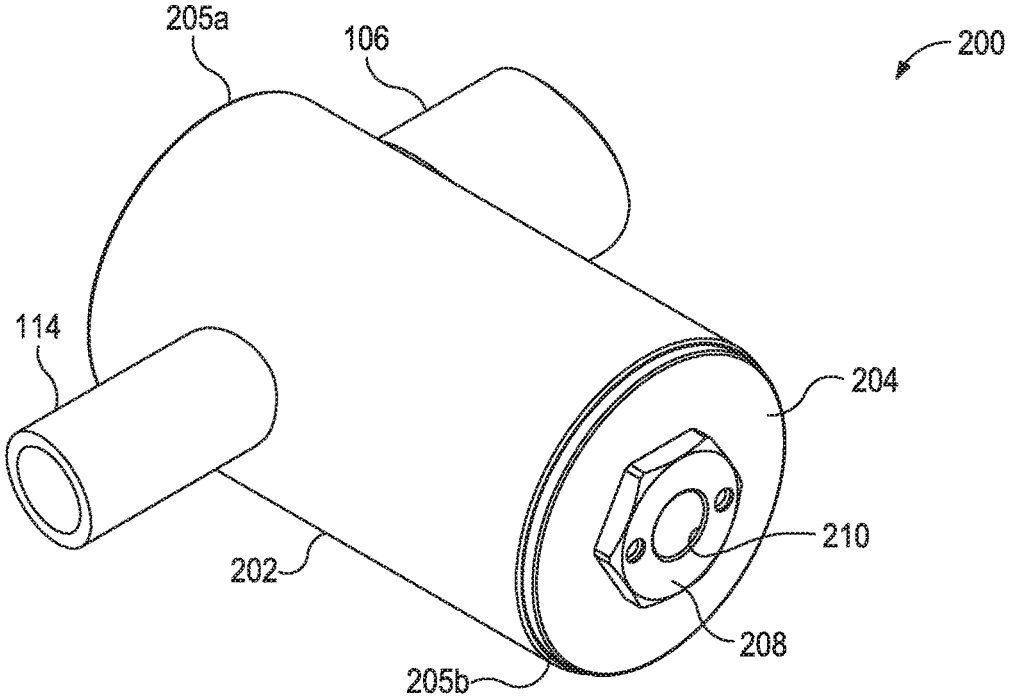
FIG. 2 is an isometric view of an exemplary burner nozzle.

Referring now to FIG. 2, illustrated is an isometric view of an exemplary burner nozzle 102, according to one or more embodiments of the present disclosure. The burner 102 may be the same as or similar to any of the burner nozzles 102 of FIG. 1 and, therefore, may be used in the burner system 100 to burn an air/well product mixture. As illustrated, the burner nozzle 102 may include an outer housing 202 and a nozzle 204 received and otherwise secured within an interior of the outer housing 202.

The outer housing 202 may exhibit a generally cylindrical shape and provide a first or top end 205*a* and a second or bottom end 205*b*. The air inlet pipe 106 may extend radially from the side of the outer housing 202 at a location between the top and bottom ends 205*a,b,* and, as discussed above, may be fluidly coupled to the air inlet manifold 104 (FIGS. 1A and 1B) to convey a flow of air into the burner nozzle 102. The well product inlet pipe 114 may also extend radially from the side of the outer housing 202 at a location between the top and bottom ends 205*a,b,* and, as also discussed above, may be fluidly coupled to the well product inlet manifold 112 (FIGS. 1A and 1B) to convey a flow of the well product into the burner nozzle 102.

In the illustrated embodiment, the air and well product inlet pipes 106, 114 are depicted as being located radially opposite each other about the periphery of the outer housing 202. In other embodiments, however, the air and well product inlet pipes 106, 114 may be angularly offset from each other about the periphery of the outer housing 202, but not radially opposite, without departing from the scope of the disclosure. In some embodiments, one or both of the air and well product inlet pipes 106, 114 may form an integral part or extension of the outer housing 202 at their respective locations. In other embodiments, however, one or both of the air and well product inlet pipes 106, 114 may be directly or indirectly coupled to the outer surface of the outer housing 202 at their respective locations.

The nozzle 204 may be received within the interior of the outer housing 202 and secured thereto at the bottom end 205*b*. In some embodiments, for example, the nozzle 204 may be threaded into the outer housing 202. To help facilitate this threaded engagement, the nozzle 204 may provide a hex nut feature 208 that may allow torque to be transferred to the nozzle 204 so that it may be threaded into the outer housing 202. The nozzle 204 may alternatively be secured within the outer housing 202 by other means including, but not limited to, one or more mechanical fasteners (e.g., screws, bolts, snap rings, pins, etc.), a press-fit, a shrink-fit, welding, brazing, an adhesive, and any combination thereof. As depicted, the nozzle 204 may provide and otherwise define a nozzle outlet 210. In operation, as discussed below, the burner nozzle 102 may discharge an air/well product mixture via the nozzle outlet 210, and the air/well product mixture is subsequently ignited and burned.

Figure 3A:
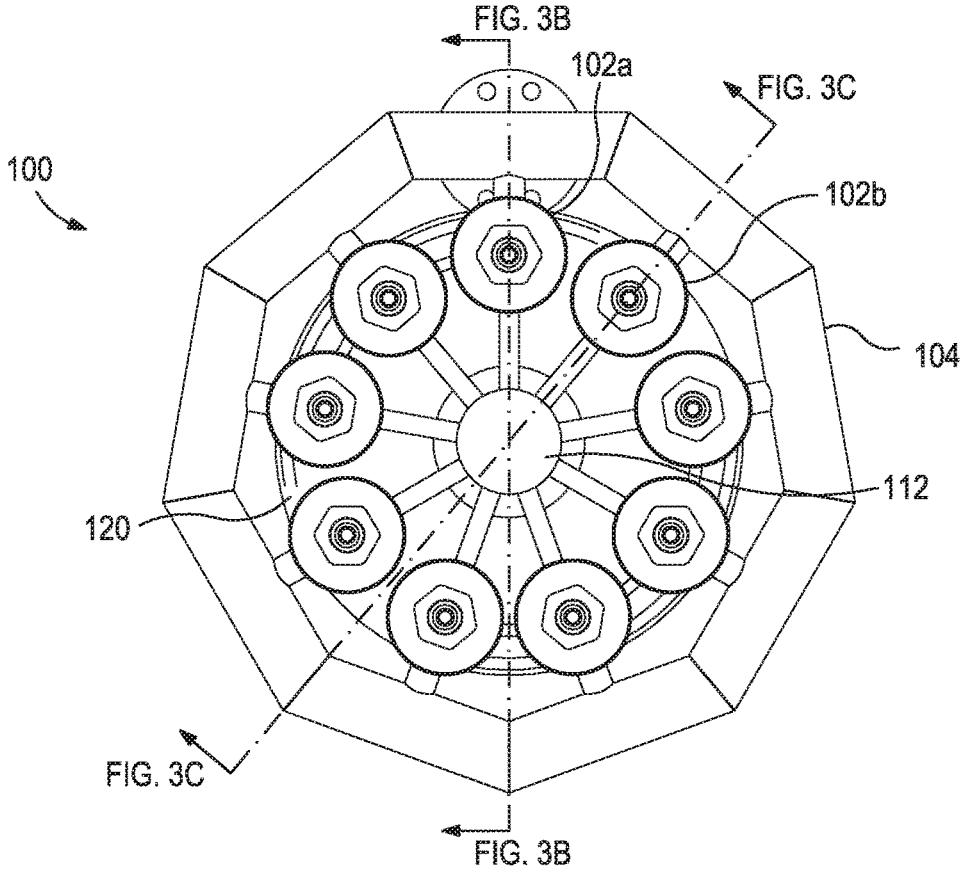
FIG. 3A is a frontal view of the burner system of FIG. 1.
Figure 3C:
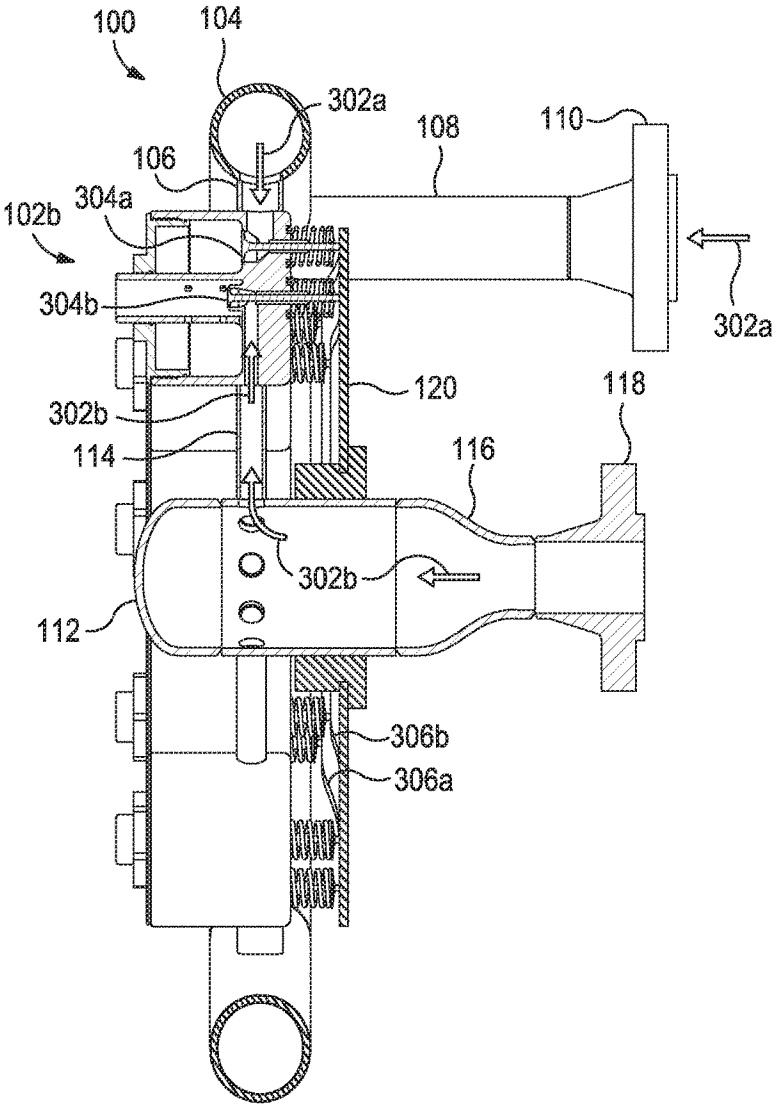
FIGS. 3B and 3C are cross-sectional side views of the burner system of FIG. 1 taken along the indicated lines in FIG. 3A.
Figure 3B:
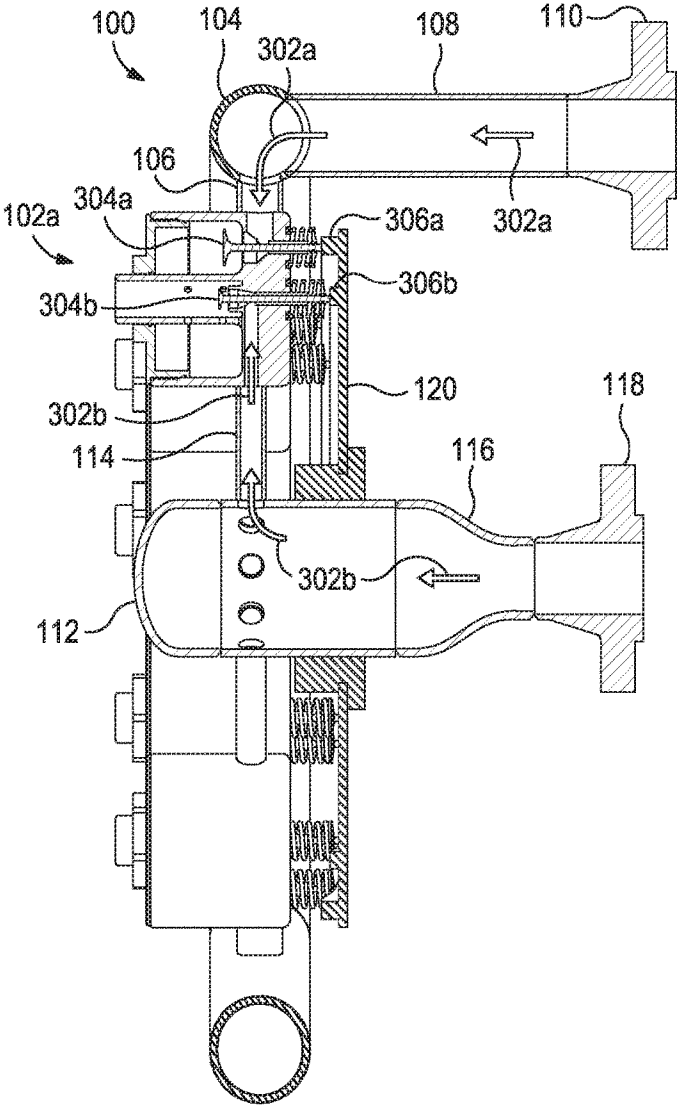

FIG. 3A is a frontal view of the burner system 100 of FIG. 1, and FIGS. 3B and 3C are cross-sectional side views of the burner system 100 taken along the lines indicated in FIG. 3A. More particularly, FIG. 3B provides a cross-sectional side view of the burner system 100 through a first burner nozzle 102*a*, and FIG. 3C provides a cross-sectional side view of the burner system 100 through a second burner nozzle 102*b,* where the first and second burner nozzles 102*a,b* are angularly adjacent one another in the circular array of burner nozzles 102. Similar reference numerals from FIGS. 1A and 1B that are used in FIGS. 3A-3C represent like components or elements of the burner system 100 that may not be described again in detail.

As shown in FIGS. 3B and 3C, a flow of air may be conveyed from the air piping 108 to the air inlet manifold 104 and subsequently to each burner nozzle 102*a,b* via corresponding air inlet pipes 106, as indicated by the arrows 302*a*. A flow of well product may be conveyed from the well product piping 116 to the well product inlet manifold 112 and subsequently to each burner nozzle 102*a,b* via corresponding well product inlet pipes 114, as indicated by the arrows 302*b*.

The actuation device 120 may be operatively coupled to each burner nozzle 102*a,b* to selectively control the flow of the air 302*a* and the well product 302*b* into the burner nozzles 102*a,b*. More particularly, the actuation device 120 may be configured to actuate and otherwise move an air valve 304*a* and a well product valve 304*b,* each movably positioned within each burner nozzle 102*a,b,* between open and closed positions, and thereby allow or prevent the influx of the air 302*a* and the well product 302*b* in the burner nozzles 102*a,b*. FIG. 3A shows the air and well product valves 304*a,b* in the open position, where the air 302*a* and the well product 302*b* are allowed to pass into the burner nozzles 102*a,b,* and FIG. 3B shows the air and well product valves 304*a,b* in the closed position, where the air 302*a* and the well product 302*b* are prevented from entering the burner nozzles 102*a,b*.

In the illustrated embodiment, the actuation device 120 is depicted as a cam plate that is rotatable in a either a clockwise or a counter-clockwise direction, or a combination of both. The cam plate actuation device 120 may include one or more outer radial lobes 306*a* and one or more inner radial lobes 304*b*. The outer and inner radial lobes 306*a,b* may be arranged and otherwise configured such that, as the cam plate actuation device 120 rotates (in either angular direction), the outer and inner radial lobes 306*a,b* sequentially engage and the air and well product valves 304*a,b,* and thereby move the air and well product valves 304*a,b* between the open and closed configurations.

Figure 4B:
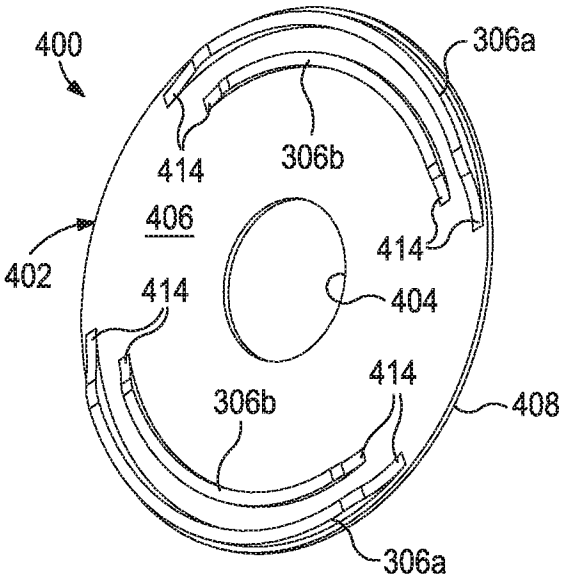
FIGS. 4A and 4B depict frontal and isometric views of an exemplary cam plate that can be used as an actuation device.
Figure 4A:
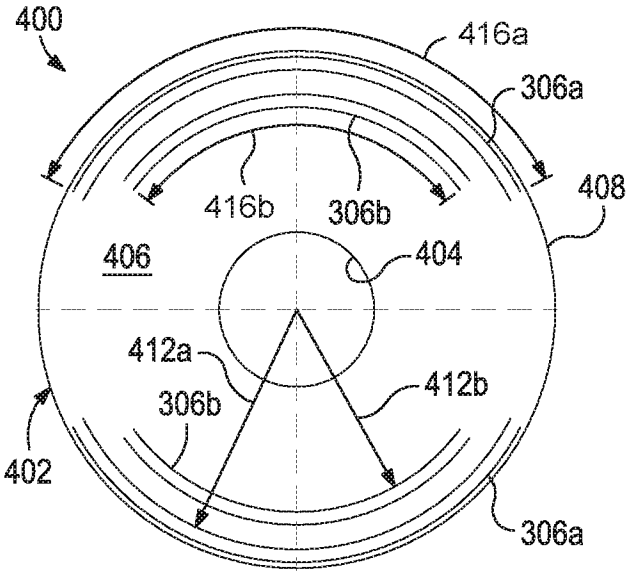

FIGS. 4A and 4B depict frontal and isometric views of an exemplary cam plate 400 that can be used as an actuation device, according to one or more embodiments. The cam plate 400 may be the same as or similar to the cam plate actuation device 120 shown in FIGS. 1A-1B and 3A-3C. As illustrated, the cam plate 400 may comprise a substantially circular body 402 that defines or provides a central aperture 404 configured to receive and otherwise accommodate the well product inlet manifold 112 (FIGS. 3B and 3C). The body 402 may further provide a planar face 406 that extends between the central aperture 404 and an outer periphery 408 of the body 402.

The cam plate 400 may further include the one or more outer radial lobes 306*a* and the one or more inner radial lobes 306*b*. As illustrated, the outer and inner radial lobes 306*a,b* may protrude or extend axially from the planar face 406. In some embodiments, the outer and inner radial lobes 306*a,b* may protrude from the planar face 406 to the same height or elevation, where "height" and "elevation" refer to the distance the outer and inner radial lobes 306*a,b* extend from the planar face 406. In other embodiments, however, the outer and inner radial lobes 306*a,b* may protrude from the planar face 406 to different heights or elevations.

In the illustrated embodiment, there are two outer radial lobes 306*a* and two inner radial lobes 306*b*. In other embodiments, however, there may be more or less than two outer and inner radial lobes 306*a,b,* without departing from the scope of the disclosure. Moreover, in the illustrated embodiment, the two outer radial lobes 306*a* are depicted as being located circumferentially opposite each other on the planar face 406 and the two inner radial lobes 306*b* are similarly depicted as being located circumferentially opposite each other on the planar face 406. In other embodiments, however, the two outer radial lobes 306*a* need not be circumferentially opposite each other and the two inner radial lobes 306*b* similarly need not be circumferentially opposite each. Furthermore, the inner radial lobes 306*b* are depicted as being concentrically positioned within the outer radial lobes 306*a,* where the outer and inner radial lobes 306*a,b* are angularly aligned, with the outer radial lobes 306*a* being located radially outward from the inner radial lobes 306*b*. In other embodiments, however, the outer and inner radial lobes 306*a,b* may be angularly misaligned, without departing from the scope of the disclosure.

The outer radial lobes 306*a* may be defined on the planar surface 406 at a first radius 412*a* (FIG. 4A) from the center of the body 402, and the inner radial lobes 306*b* may be defined on the planar surface 406 at a second radius 412*b* (FIG. 4A) from the center of the body 402. When the cam plate 400 is installed in the burner system 100 of FIGS. 3A-3C, the first radius 412*a* may be configured to radially align with the air valve 304*a* (FIGS. 3B-3C) and the second radius 412*b* may be configured to radially align with the well product valve 304*b* (FIGS. 3B-3C). As a result, as the cam plate 400 rotates in either angular direction, the outer and inner radial lobes 306*a,b* may sequentially engage and move the air and well product valves 304*a,b*, respectively, between the open and closed positions.

In some embodiments, as best seen in FIG. 4B, a transition surface 414 may be provided or otherwise defined at one or both arcuate ends of the outer and inner radial lobes 306*a,b*. The transition surface 414 may be a ramped or angled surface that provides a gradual transition between the planar face 406 of the body 402 and the top (i.e., axial height or extent) of each outer and inner radial lobe 306*a,b*. As the cam plate 400 rotates in either angular direction, the transition surfaces 414 allow the air and well product valves 304*a,b* (FIGS. 3B-3C) to gradually or controllably transition between the open and closed positions as they move between the planar face 406 and the tops of each outer and inner radial lobe 306*a,b*. In other embodiments, however, the transition surfaces 414 may be omitted on one end of the outer and inner radial lobes 306*a,b* and otherwise provide an abrupt transition between the top of the outer and inner radial lobes 306*a,b* and the planar face 406 as the cam plate 400 rotates. In such embodiments, the abrupt transition surface 414 may allow the air and well product valves 304*a,b* to rapidly move from the open position to the closed position.

As shown in FIG. 4A, the outer radial lobes 306*a* may exhibit an outer arcuate length 416*a* and the inner radial lobes 306*b* may exhibit an inner arcuate length 416*b*. In conjunction with the number of outer and inner radial lobes 306*a,b* and a given rotational speed (RPM) of the cam plate 400, the respective lengths of the outer and inner arcuate lengths 416*a,b* may be designed to coincide with a desired time or period to maintain the air and well product valves 304*a,b* (FIGS. 3B-3C) either open or closed. Accordingly, the cam plate 400 may be designed such that the opening and closing of the air and well product valves 304*a,b* is coordinated and otherwise known. As will be appreciated, the number of outer and inner radial lobes 306*a,b,* the rotational speed (RPM) of the cam plate 400, and the outer and inner arcuate lengths 416*a,b* may be jointly optimized to desired specifications, depending on the particular application.

Figure 5A:
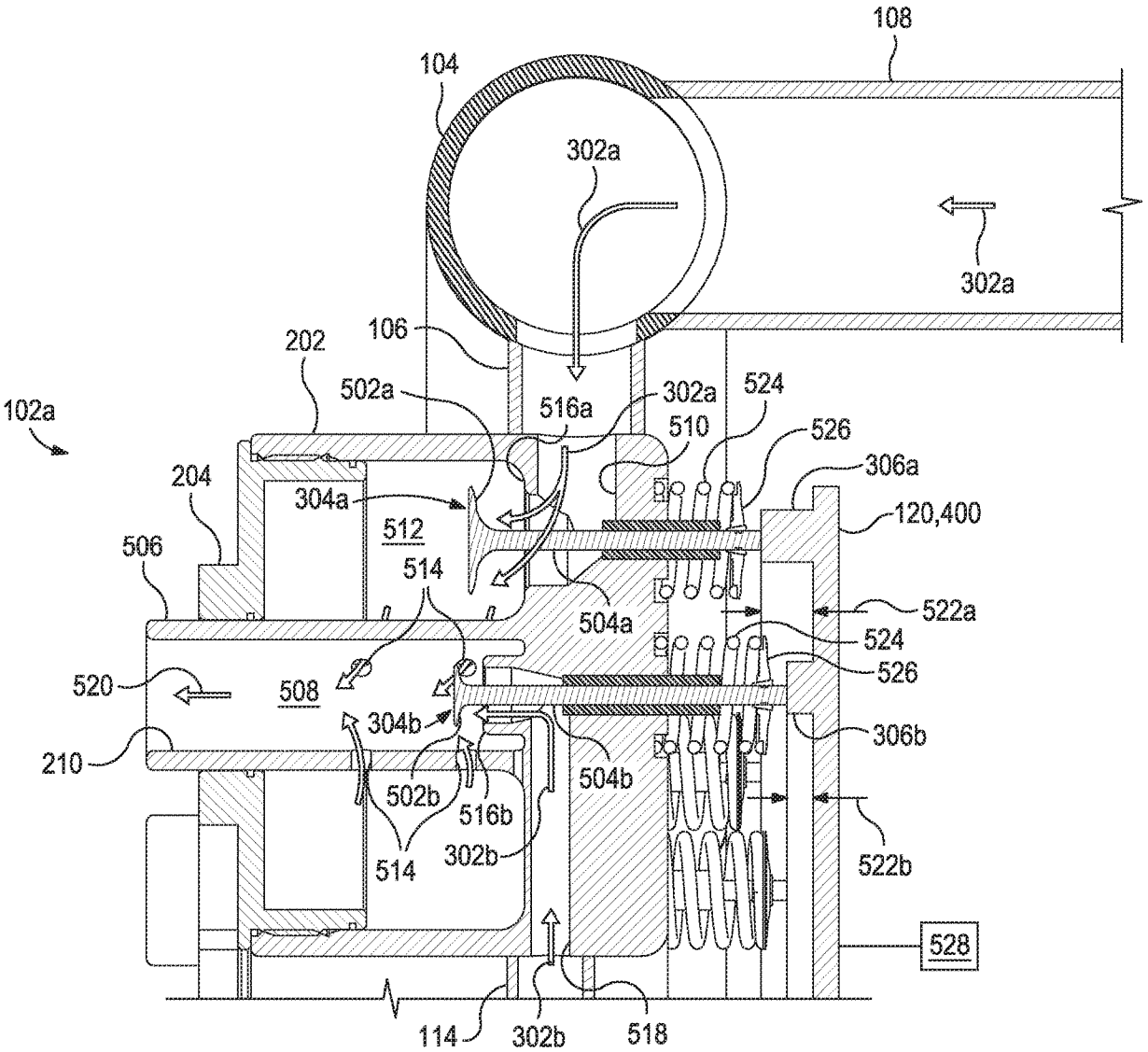
FIGS. 5A and 5B are enlarged cross-sectional side views of the first and second burner nozzles of FIGS. 3B and 3C, respectively.
Figure 5B:
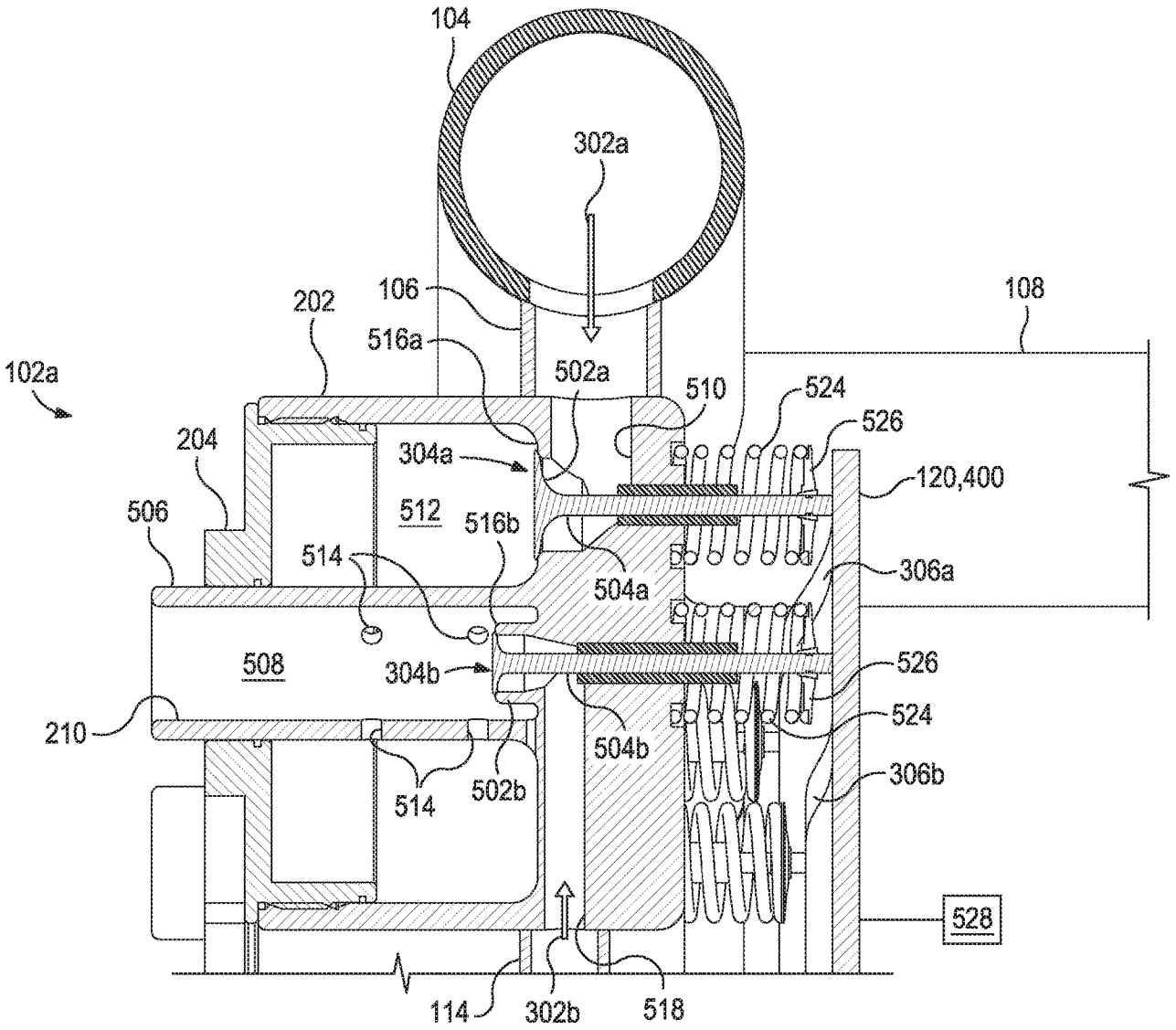

FIGS. 5A and 5B are enlarged cross-sectional side views of the first and second burner nozzles 102*a,b* of FIGS. 3B and 3C, respectively. Similar reference numerals from FIGS. 1A-1B and FIGS. 3A-3C that are used in FIGS. 5A and 5B represent like components or elements of the burner system 100 that may not be described again in detail. FIG. 5A shows the air and well product valves 304*a,b* of the first burner nozzle 102*a* in respective open positions, and FIG. 5B shows the air and well product valves 304*a,b* of the second burner nozzle 102*b* in respective closed positions. The air valves 304*a* may each provide a head 502*a* and a stem 504*a* that extends axially from the head 502*a*, and the well product valves 304*b* may similarly each provide a head 502*b* and a stem 504*b* that extends axially from the head 502*b*. The stems 504*a,b* may each extend to operatively engage the actuation device 120.

Each burner nozzle 102*a,b* may include and otherwise provide a nozzle body 506, which, as shown in the illustrated embodiment, may extend out of the nozzle 204. The nozzle body 506 may define an atomizing chamber 508, and the nozzle outlet 210 may be provided at the distal end thereof.

The flow of air 302*a* is conveyed to each burner nozzle 102*a,b* via the air inlet manifold 104 and corresponding air inlet pipes 106. The incoming air 302*a* may enter the burner nozzles 102*a,b* at an air inlet conduit 510 defined in the outer housing 202 of each burner nozzle 102*a,b*. When the air valve 304*a* is in the open position, as shown in FIG. 5A, the air inlet conduit 510 may convey the air 302*a* past the air valve 304*a* and into an air chamber 512 defined within the burner nozzle 102*a,b* and, more particularly, cooperatively defined by the outer housing 202 and the nozzle 204. Once in the air chamber 512, the air 302*a* may be able to enter the atomizing chamber 508 via one or more apertures 514 defined in the nozzle body 506. However, when the air valve 304*a* is in the closed position, as shown in FIG. 5B, the head 502*a* of the air valve 304*a* seats against and otherwise engages a valve seat 516*a*, which prevents the air 302*a* from migrating into the air chamber 512.

The flow of the well product 302*b* is conveyed to each burner nozzle 102*a,b* via corresponding well product inlet pipes 114 fluidly coupled to the well product inlet manifold 112 (FIGS. 1A-1B and 3A-3C). The incoming well product 302*b* may enter the burner nozzles 102*a,b* at a well product inlet conduit 518 defined in the outer housing 202 of each burner nozzle 102*a,b*. When the well product valve 304*b* in the open position, as shown in FIG. 5A, the well product inlet conduit 518 may feed the well product 302*b* into the atomizing chamber 508 to be mixed with the air 302*a*. However, when the well product valve 304*b* is in the closed position, as shown in FIG. 5B, the head 502*b* of the well product valve 304*b* seats against and otherwise engages a valve seat 516*b*, which prevents the well product 302*b* from migrating into the atomizing chamber 512.

The apertures 514 and the well product inlet conduit 518 may each exhibit a predetermined flow area configured to meter a known amount of air 302*a* and well product 302*b*, respectively, into the atomizing chamber 508 to be mixed and otherwise combined. As a result, when the air and well product valves 304*a,b* are in their respective open positions, as shown in FIG. 5A, a specified or predetermined ratio of air 302*a* and well product 302*b* may be supplied to the atomizing chamber 508 and combined to create an air/well product mixture 520 having a known ratio. The resulting air/well product mixture 520 may then be discharged from the atomizing chamber 508 via the nozzle outlet 210 to be burned.

As indicated above, the actuation device 120 (i.e., the cam plate 400 of FIGS. 4A and 4B) may be operatively coupled to each burner nozzle 102*a,b* to selectively control the flow of the air 302*a* and the well product 302*b* into the burner nozzles 102*a,b*, and thereby control the discharge of the air/well product mixture 520. More particularly, the outer radial lobes 306*a* may be radially aligned and, therefore, engageable with the stem 504*a* of the air valve 304*a*, and the inner radial lobes 306*b* may be radially aligned and, therefore, engageable with the stem 504*b* of the well product valve 304*b*. As a result, as the actuation device 120 (the cam plate 400) rotates in either angular direction, the outer and inner radial lobes 306*a,b* may sequentially engage and move the air and well product valves 304*a,b*, respectively, between the open and closed positions.

In some embodiments, the end of each stem 504*a,b* may include some type of friction-reducing device or mechanism configured to allow the stems 504*a,b* to engage the outer and inner and outer lobes 306*a,b* , respectively, with little to no friction. In some embodiments, for instance, the end of one or both of the stems 504*a,b* may include a wheel or other rolling member that allows the stems 504*a,b* to rollingly engage the outer and inner and outer lobes 306*a,b*, respectively. In other embodiments, the end of one or both of the stems 504*a,b* may be capped with a spherical member made of a low-friction material (e.g., TEFLON®, etc.) or polished so as provide an engagement with the outer and inner and outer lobes 306*a,b*, respectively, with little to no friction. In yet other embodiments, the end of one or both of the stems 504*a,b* may include an intermediate plate with a corresponding housing that is similar to a lifter in an internal combustion engine. The intermediate plate may similarly serve to provide an engagement with the outer and inner and outer lobes 306*a,b*, respectively, with little to no friction.

As best seen in FIG. 5A, the outer radial lobes 306*a* may exhibit a first height 522*a* and the inner radial lobes 306*b* may exhibit a second height 522*b*. In some embodiments, the first and second heights 522*a,b* may be the same. However, in other embodiments, as is illustrated, the first and second heights 522*a,b* may be different. As the actuation device 120 (the cam plate 400) rotates in either angular direction, the stems 504*a,b* may be configured to ride up corresponding transition surfaces 414 (FIG. 4B) of the outer and inner radial lobes 306*a,b* to the corresponding heights 522*a,b*. This may result in the heads 502*a,b* of each air and well product valve 304*a,b*, respectively, moving off the corresponding valve seats 516*a,b* to the same distance, and thereby placing the air and well product valves 304*a,b* in their respective open positions.

In the illustrated embodiment, the air and well product valves 304*a,b* are depicted as being spring-loaded valves. More particularly, the air and well product valves 304*a,b* may each include a compression spring 524 operatively coupled to the stems 504*a,b* at a clasp 526. The compression spring 524 may exhibit a spring force that constantly urges the air and well product valves 304*a,b* to the closed position. As the stems 504*a,b* engage the outer and inner radial lobes 306*a,b* to the corresponding heights 522*a,b*, the compression springs 524 may each be compressed. Further rotation of the actuation device 120 (the cam plate 400) may allow the stems 504*a,b* to ride down corresponding transition surfaces 414 (FIG. 4B) and back to the planar surface 406 (FIGS. 4A-4B). The compression springs 524 may then be allowed to release their built-up spring force, which may move the heads 502*a,b* of each air and well product valve 304*a,b*, respectively, back against the corresponding valve seats 516*a,b*, and thereby move the air and well product valves 304*a,b* to the closed position of FIG. 5B.

The actuation device 120 (the cam plate 400) may be operatively coupled to a motor 528 or configured to rotate the actuation device 120/cam plate 400 in either a clockwise or a counter-clockwise direction, or a combination of both. The motor 528 may be configured to rotate the actuation device 120/cam plate 400 at any desired velocity (RPM). As will be appreciated, the rotational speed of the actuation device 120/cam plate 400 may comprise one parameter that dictates how long the air and well product valves 304*a,b* remain open or closed during operation. Other parameters that may dictate how long the air and well product valves 304*a,b* remain open or closed include the number of outer and radial lobes 306*a,b* and the length of the outer and inner arcuate lengths 416*a,b* (FIG. 4A) of the outer radial lobes 306*a,b*, respectively. Accordingly, the parameters of the actuation device 120/cam plate 400 may be configured and otherwise designed such that the opening and closing of the air and well product valves 304*a,b* is coordinated and otherwise known.

In some embodiments, the outer arcuate length 416*a* (FIG. 4A) of the outer radial lobe 306*a* may be longer than the inner arcuate length 416*b* (FIG. 4A) of the inner radial lobe 306*b* such that, as the actuation device 120/cam plate 400 rotates, the air valve 304*a* opens before the well product valve 304*b* opens, and the air valve 304*a* closes after the well product valve 304*b* closes. As a result, the flow of the air 302*a* into the atomizing chamber 508 will commence prior to the flow of the well product 302*b* into the atomizing chamber 508. Moreover, the flow of the well product 302*b* into the atomizing chamber 508 will be stopped prior to stopping the flow of the air 302*a* into the atomizing chamber 508 via the apertures 514. As will be appreciated, this relationship ensures that no un-atomized well product 302*b* is expelled from the nozzle outlet 210.

Figure 6A:
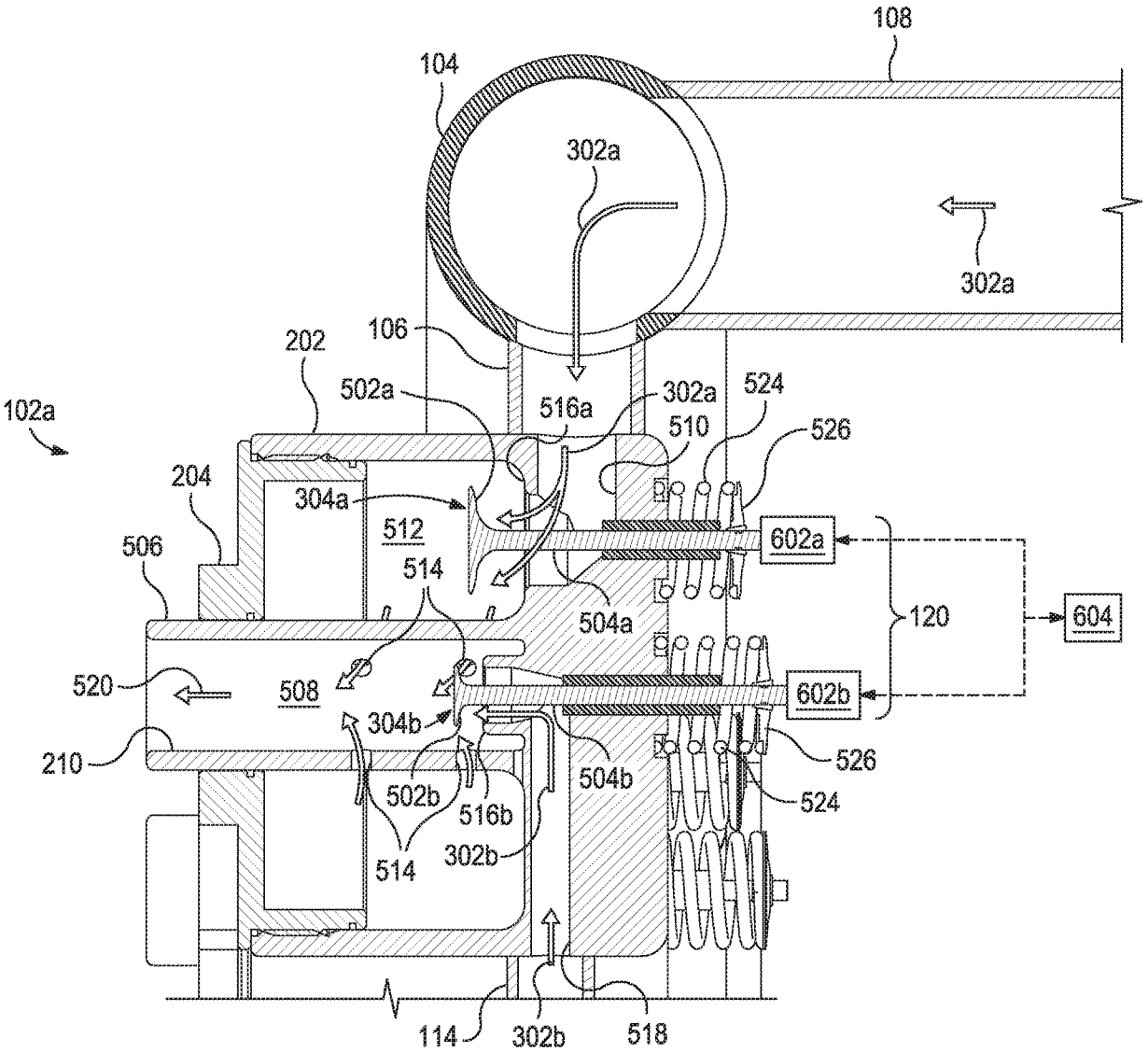
FIGS. 6A and 6B are enlarged cross-sectional side views of another embodiment of the first and second burner nozzles of FIGS. 3B and 3C, respectively.
Figure 6B:
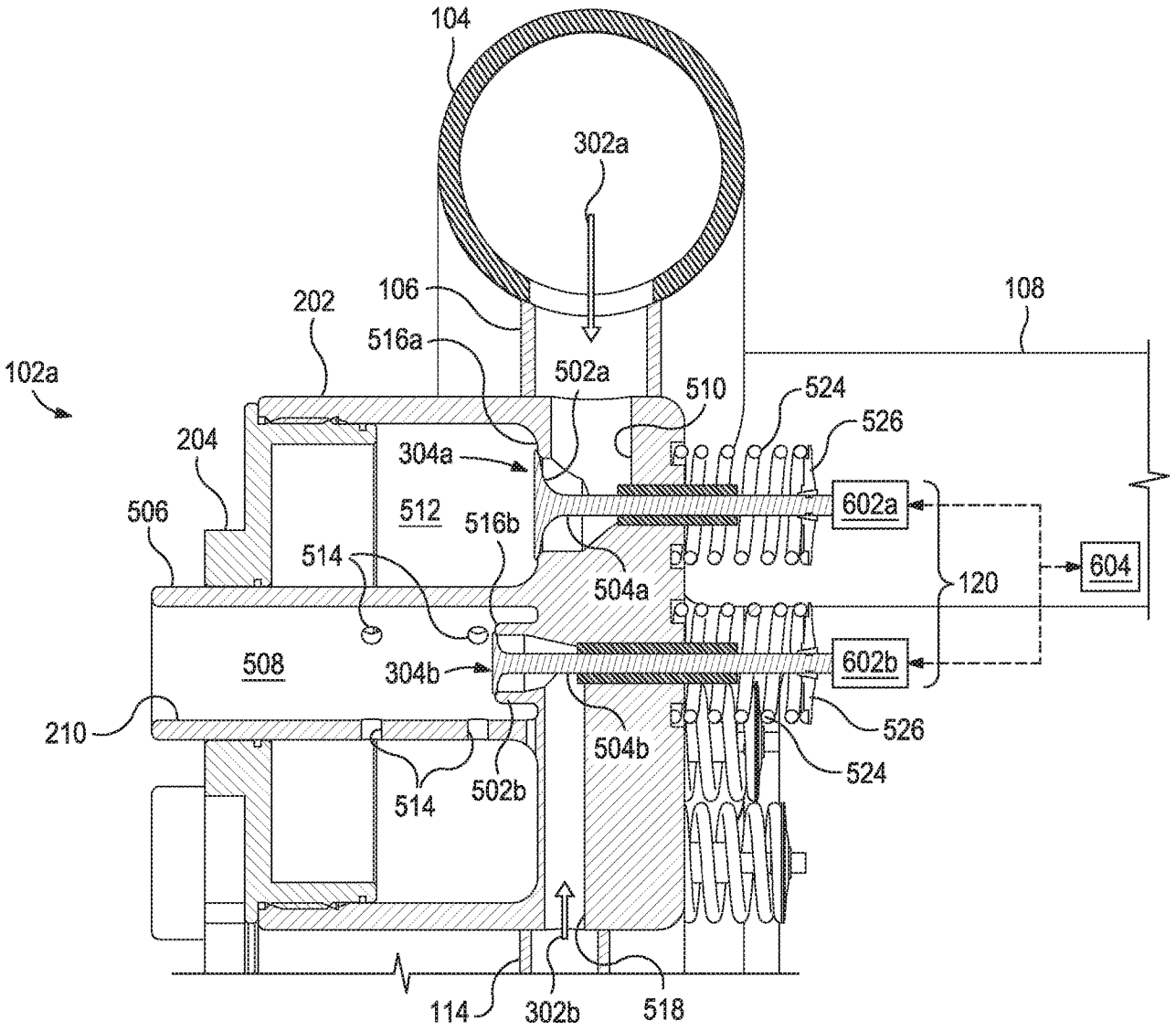

FIGS. 6A and 6B are enlarged cross-sectional side views of another embodiment of the first and second burner nozzles 102*a,b* of FIGS. 3B and 3C, respectively. The embodiment shown in FIGS. 6A and 6B may be similar in most respects to the embodiment of FIGS. 5A and 5B and therefore may be best understood with reference thereto, where like numerals represent like components or elements of the first and second burner nozzles 102*a,b* that may not be described again in detail. FIG. 6A shows the air and well product valves 304*a,b* of the first burner nozzle 102*a* in respective open positions, and FIG. 6B shows the air and well product valves 304*a,b* of the second burner nozzle 102*b* in respective closed positions.

Unlike the embodiment of FIGS. 5A-5B, however, the actuation device 120 shown in the embodiment of FIGS. 6A-6B may comprise one or more actuation mechanisms 602 configured to selectively open and close the air and well product valves 304*a,b*. More particularly, a first actuation mechanism 602*a* is shown operatively coupled to the air valve 304*a* and a second actuation mechanism 602*b* is shown operatively coupled to the well product valve 304*b*. The actuation mechanisms 602*a,b* may comprise any mechanical, electromechanical, hydraulic, or pneumatic actuator or device configured to actuate upon command. In at least one embodiment, the actuation mechanisms 602*a,b* may comprise corresponding piston solenoid combinations.

The actuation mechanisms 602*a,b* may be operatively coupled to the stems 504*a,b* of the air and well product valves 304*a,b*, respectively. Upon receipt of a command signal or at a predetermined or preselected time interval, the actuation mechanisms 602*a,b* may be actuated to selectively move the air and well product valves 304*a,b* between the open and closed positions. The timing for opening and closing the air and well product valves 304*a,b* may be coordinated so that the correct mixture of air 302*a* and well product 302*b* is used to form the air/well product mixture 520. Moreover, the timing for opening and closing the air and well product valves 304*a,b* for all of the burner nozzles 102 of FIG. 3A may be coordinated in a selected pattern, such as proceeding sequentially in an angular direction about the circumference of the array of burner nozzles. In at least one embodiment, the actuation mechanisms 602*a,b* may be programmed such that the air valve 304*a* remains open while the well product valve 304*b* is closed, thereby allowing a flow of air 302*a* to continuously circulate through and cool the burner nozzles 102*a,b* by removing heat. As a result, the adverse effects of radiant thermal energy emitted by adjacent burner nozzles 102 may be mitigated.

In the illustrated embodiment, the air and well product valves 304*a,b* are depicted as being spring-loaded valves that include the compression springs 524 described above. The compression springs 524, however, may or may not be used in this embodiment, since the actuation mechanisms 602*a,b* may be configured to push and pull on the stems 504*a,b* of the air and well product valves 304*a,b*, respectively. As a result, the actuation mechanisms 602*a,b* may be configured to move the air and well product valves 304*a,b* between the open and closed positions without the help of the compression springs 524.

Since the embodiment of FIGS. 6A and 6B does not rely on rotation of a cam plate (i.e., the cam plate 400 of FIGS. 4A and 4B), the burner nozzles 102 used in the burner system 100 need not be arranged in a circular pattern, as shown in FIGS. 1A and 3A. Rather, the burner nozzles 102 used in the embodiment of FIGS. 6A-6B could be arranged in any pattern or shape, such as square or rectangular, and the actuation mechanisms 602*a,b* may be configured to selectively move the corresponding air and well product valves 304*a,b* of each burner nozzle between open and closed positions as desired.

The actuation mechanisms 602*a,b* may each be communicably coupled to a central processor or computer 604 used to control actuation. The computer 604 can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable programmable read only memory (EPROM)), registers, hard disks, removable disks, CD-ROMS, DVDs, or any other like suitable storage device or medium.

Selectively moving the air and well product valves 304*a,b* between the open and closed positions with the actuation mechanisms 602*a,b* may prove advantageous in providing real-time adjustability of one or both of the air and well product valves 304*a,b*. As a result, for example, a well operator may be able to control the flow rate of the well product 302*b*, without significantly depending on pressure, which would be advantageous in adjusting air/well product ratios. Accordingly, in at least one embodiment, the flow rate of the well product 302*b* may be varied, provided the pressure is high enough to meet that flow rate with the well product valve 304*b* in the fully open position, by quickly opening and closing the well product valve 304*b* at different duty cycles.

Embodiments disclosed herein include:

A. A well test burner system that includes a plurality of burner nozzles, each including an air valve and a well product valve movable between an open position, where air and a well product are allowed to circulate through the burner nozzle to discharge an air/well product mixture, and a closed position, where the air and the well product are prevented from circulating through the burner nozzle, and one or more actuation devices operatively coupled to the air valve and the well product valve of each burner nozzle to move the air valve and the well product valve between the open and closed positions.

B. A method that includes supplying air and a well product to a plurality of burner nozzles, each burner nozzle including an air valve and a well product valve, and actuating the air valve and the well product valve of each burner nozzle between an open position and a closed position with one or more actuation devices operatively coupled to the air valve and the well product valve of each burner nozzle, wherein, when the air valve and the well product valve are in the open position the air and the well product circulate through the burner nozzle and discharge an air/well product mixture, and wherein, when the air valve and the well product valve are in the closed position the air and the well product are prevented from circulating through the burner nozzle.

Each of embodiments A and B may have one or more of the following additional elements in any combination: Element 1: wherein the plurality of burner nozzles is arranged in a circular array, the well test burner system further comprising an air inlet manifold extending about the circular array, an air inlet pipe extending radially between the air inlet manifold and each burner nozzle to provide air to the plurality of burner nozzles, a well product inlet manifold, and a well product inlet pipe extending between the well product inlet manifold and each burner nozzle to provide a well product to the plurality of burner nozzles. Element 2: wherein the plurality of burner nozzles is arranged in a circular array and the one or more actuation devices is a rotatable cam plate that comprises a circular body that defines a planar face extending between a central aperture defined in the body and an outer periphery of the body, one or more outer radial lobes protruding from the planar face at a first radius from a center of the body to radially align with the air valve of each burner nozzle, and one or more inner radial lobes protruding from the planar face at a second radius from the center to radially align with the well product valve of each burner nozzle. Element 3: wherein the one or more outer and inner radial lobes are angularly aligned with respect to each other to simultaneously engage the air and well product valves, respectively. Element 4: further comprising a transition surface defined at one or both arcuate ends of the outer and inner radial lobes. Element 5: wherein the one or more outer radial lobes exhibit an outer arcuate length and the one or more inner radial lobes exhibit an inner arcuate length that is shorter than the outer arcuate length such that, as the cam plate rotates, the one or more outer radial lobes engage the air valve of a given burner nozzle before the one or more inner radial lobes engage the well product valve of the given burner nozzle, and the one or more outer radial lobes disengage the air valve of the given burner nozzle after the one or more inner radial lobes disengage the well product valve of the given burner nozzle. Element 6: wherein each air valve and each well product valve provides a head and a stem that extends longitudinally from the head, and wherein the one or more outer radial lobes engage the stem of each air valve to move the air valve between the open and closed positions and the one or more inner radial lobes engage the stem of each well product valve to move the well product valve between the open and closed positions. Element 7: further comprising a motor operatively coupled to the cam plate to rotate the cam plate in either angular direction. Element 8: further comprising a compression spring coupled to each air valve and each well product valve of each burner nozzle, the compression spring exhibiting a spring force that urges the air valve and the well product valve to the closed position. Element 9: wherein the one or more actuation devices comprises a plurality of actuation devices, and each air valve and each well product valve is independently and selectively operated by an individual actuation device of the plurality of actuation devices. Element 10: wherein each air valve and each well product valve provides a head and a stem that extends longitudinally from the head, and wherein the individual actuation device of each air valve and each well product valve engages the stem to move the air valve and the well product valve between the open and closed positions. Element 11: wherein the plurality of actuation devices comprises an actuator selected from the group consisting of a mechanical actuator, an electromechanical actuator, a hydraulic actuator, a pneumatic actuator, and any combination thereof. Element 12: further comprising a computer communicably coupled to the plurality of actuation devices to selectively actuate the plurality of actuation devices.

Element 13: further comprising opening the air valve of a given burner nozzle prior opening the well product valve of the given burner nozzle, and closing the air valve of the given burner nozzle after closing the well product valve of the given burner nozzle. Element 14: wherein the plurality of burner nozzles is arranged in a circular array and the actuation device is a rotatable cam plate having one or more outer radial lobes and one or more inner radial lobes, the method further comprising rotating the cam plate, engaging the air valve of each burner nozzle with the one or more outer radial lobes as the cam plate rotates and thereby moving the air valve of each burner nozzle between the open and closed positions, and engaging the well product valve of each burner nozzle with the one or more inner radial lobes as the cam plate rotates and thereby moving the well product valve of each burner nozzle between the open and closed positions. Element 15: wherein the one or more outer and inner radial lobes are angularly aligned with respect to each other, the method further comprising simultaneously engaging the air valve and the well product valve of each burner nozzle with the one or more outer and inner radial lobes, respectively. Element 16: further comprising engaging the one or more outer radial lobes on the air valve of a given burner nozzle before the one or more inner radial lobes engage the well product valve of the given burner nozzle, and disengaging the one or more outer radial lobes from the air valve of the given burner nozzle after the one or more inner radial lobes disengage the well product valve of the given burner nozzle. Element 17: wherein the one or more actuation devices comprises a plurality of actuation devices, the method further comprising independently operating each air valve and each well product valve with an individual actuation device of the plurality of actuation devices. Element 18: wherein the plurality of actuation devices is communicably coupled to a computer, the method further comprising sending command signals to the plurality of actuation devices to selectively actuate the air valve and the well product valve of each burner nozzle.

By way of non-limiting example, exemplary combinations applicable to A, B, and C include: Element 2 with Element 3; Element 2 with Element 4; Element 2 with Element 5; Element 2 with Element 6; Element 2 with Element 7; Element 9 with Element 10; Element 9 with Element 11; Element 9 with Element 12; Element 14 with Element 15; Element 14 with Element 16; and Element 17 with Element 18.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A well test burner system, comprising:

a plurality of burner nozzles, each including an air valve and a well product valve movable between an open position, where air and a well product are allowed to circulate through the burner nozzle to discharge an air/well product mixture, and a closed position, where the air and the well product are prevented from circulating through the burner nozzle; and one or more actuation devices operatively coupled to the air valve and the well product valve of each burner nozzle to move the air valve and the well product valve between the open and closed positions, wherein the one or more actuation devices comprises a rotatable cam plate.

2. The well test burner system of claim 1, wherein the plurality of burner nozzles is arranged in a circular array, the well test burner system further comprising:

an air inlet manifold extending about the circular array;

an air inlet pipe extending radially between the air inlet manifold and each burner nozzle to provide air to the plurality of burner nozzles;

a well product inlet manifold; and a well product inlet pipe extending between the well product inlet manifold and each burner nozzle to provide a well product to the plurality of burner nozzles.

3. The well test burner system of claim 1, wherein the plurality of burner nozzles is arranged in a circular array and the rotatable cam plate comprises:

a circular body that defines a planar face extending between a central aperture defined in the body and an outer periphery of the body;

one or more outer radial lobes protruding from the planar face at a first radius from a center of the body to radially align with the air valve of each burner nozzle; and one or more inner radial lobes protruding from the planar face at a second radius from the center to radially align with the well product valve of each burner nozzle.

4. The well test burner system of claim 3, wherein the one or more outer and inner radial lobes are angularly aligned with respect to each other to simultaneously engage the air and well product valves, respectively.

5. The well test burner system of claim 3, further comprising a transition surface defined at one or both arcuate ends of the outer and inner radial lobes.

6. The well test burner system of claim 3, wherein the one or more outer radial lobes exhibit an outer arcuate length and the one or more inner radial lobes exhibit an inner arcuate length that is shorter than the outer arcuate length such that, as the cam plate rotates, the one or more outer radial lobes engage the air valve of a given burner nozzle before the one or more inner radial lobes engage the well product valve of the given burner nozzle, and the one or more outer radial lobes disengage the air valve of the given burner nozzle after the one or more inner radial lobes disengage the well product valve of the given burner nozzle.

7. The well test burner system of claim 3, wherein each air valve and each well product valve provides a head and a stem that extends longitudinally from the head, and wherein the one or more outer radial lobes engage the stem of each air valve to move the air valve between the open and closed positions and the one or more inner radial lobes engage the stem of each well product valve to move the well product valve between the open and closed positions.

8. The well test burner system of claim 3, further comprising a motor operatively coupled to the cam plate to rotate the cam plate in either angular direction.

9. The well test burner system of claim 1, further comprising a compression spring coupled to each air valve and each well product valve of each burner nozzle, the compression spring exhibiting a spring force that urges the air valve and the well product valve to the closed position.

10. The well test burner system of claim 1, wherein the one or more actuation devices comprises a plurality of actuation devices, and each air valve and each well product valve is independently and selectively operated by an individual actuation device of the plurality of actuation devices.

11. The well test burner system of claim 10, wherein each air valve and each well product valve provides a head and a stem that extends longitudinally from the head, and wherein the individual actuation device of each air valve and each well product valve engages the stem to move the air valve and the well product valve between the open and closed positions.

12. The well test burner system of claim 10, wherein the plurality of actuation devices comprises an actuator selected from the group consisting of a mechanical actuator, an electromechanical actuator, a hydraulic actuator, a pneumatic actuator, and any combination thereof.

13. The well test burner system of claim 10, further comprising a computer communicably coupled to the plurality of actuation devices to selectively actuate the plurality of actuation devices.

14. A method, comprising:

supplying air and a well product to a plurality of burner nozzles, each burner nozzle including an air valve and a well product valve; and actuating the air valve and the well product valve of each burner nozzle between an open position and a closed position with one or more actuation devices operatively coupled to the air valve and the well product valve of each burner nozzle, wherein the actuation device comprises a rotatable cam plate, wherein, when the air valve and the well product valve are in the open position the air and the well product circulate through the burner nozzle and discharge an air/well product mixture, and wherein, when the air valve and the well product valve are in the closed position the air and the well product are prevented from circulating through the burner nozzle.

15. The method of claim 14, further comprising:

opening the air valve of a given burner nozzle prior to opening the well product valve of the given burner nozzle; and closing the air valve of the given burner nozzle after closing the well product valve of the given burner nozzle.

16. The method of claim 14, wherein the plurality of burner nozzles is arranged in a circular array and the rotatable cam plate comprises one or more outer radial lobes and one or more inner radial lobes, the method further comprising:

rotating the cam plate;

engaging the air valve of each burner nozzle with the one or more outer radial lobes as the cam plate rotates and thereby moving the air valve of each burner nozzle between the open and closed positions; and engaging the well product valve of each burner nozzle with the one or more inner radial lobes as the cam plate rotates and thereby moving the well product valve of each burner nozzle between the open and closed positions.

17. The method of claim 16, wherein the one or more outer and inner radial lobes are angularly aligned with respect to each other, the method further comprising simultaneously engaging the air valve and the well product valve of each burner nozzle with the one or more outer and inner radial lobes, respectively.

18. The method of claim 16, further comprising:

engaging the one or more outer radial lobes on the air valve of a given burner nozzle before the one or more inner radial lobes engage the well product valve of the given burner nozzle; and disengaging the one or more outer radial lobes from the air valve of the given burner nozzle after the one or more inner radial lobes disengage the well product valve of the given burner nozzle.

19. The method of claim 14, wherein the one or more actuation devices comprises a plurality of actuation devices, the method further comprising independently operating each air valve and each well product valve with an individual actuation device of the plurality of actuation devices.

20. The method of claim 19, wherein the plurality of actuation devices is communicably coupled to a computer, the method further comprising sending command signals to the plurality of actuation devices to selectively actuate the air valve and the well product valve of each burner nozzle.

* * * * *